United States Patent [19]

Cavagna

[11] Patent Number: 4,641,575

[45] Date of Patent: Feb. 10, 1987

[54] DEVICE FOR EMBOSSING AND/OR CREASING SHEET, OR ROLL MATERIAL

[75] Inventor: Elio Cavagna, Melegnano, Italy

[73] Assignee: Elio Cavagna S.r.l., Melegnano, Italy

[21] Appl. No.: 810,028

[22] Filed: Dec. 17, 1985

[51] Int. Cl.[4] ..... B41F 1/07

[52] U.S. Cl. ..... 101/23; 493/442; 493/454; 493/471; 493/475

[58] Field of Search ..... 101/28, 23, 6; 493/471, 493/473, 475, 476, 442, 445, 454

[56] References Cited

U.S. PATENT DOCUMENTS

| | | | |
|---|---|---|---|
| 2,611,312 | 9/1952 | Illner | 101/23 |
| 2,691,328 | 10/1954 | Evers | 493/471 |
| 2,876,734 | 3/1959 | Nitchie | 101/23 X |
| 3,089,695 | 3/1963 | Brooks | 493/442 |
| 3,572,687 | 3/1971 | Lindley | 493/442 |
| 4,580,492 | 4/1986 | Troyan et al. | 101/28 |

*Primary Examiner*—E. H. Eickholt

*Attorney, Agent, or Firm*—Bucknam and Archer

[57] ABSTRACT

Device for embossing and/or creasing sheet, or roll material, including a fixed structure complete with a central, moving rod and two symmetric, side chambers in which two pistons slide, opposed by elastic means; means to supply a pressurized fluid in the upper part of each chamber; an embossing and/or creasing tool-holder fixed to the free end of the said rod and of the said stems and a system to control, in an approximate and micrometric manner, the degree of approach of the tool to the counter-roller on which the paper material to be treated travels.

7 Claims, 3 Drawing Figures

DEVICE FOR EMBOSSING AND/OR CREASING SHEET, OR ROLL MATERIAL

BACKGROUND OF THE INVENTION

1. Field of the Invention

This invention refers to a device for embossing and/or creasing material, preferably paper and prevailently bi-dimensional, pre-arranged in a continuous sheet and preferably in rolls, or a reel.

The material to be treated usually has a height that is a whole multiple of that of the product it is intended to produce, such as toilet paper rolls, sheet to be divided successively into numerous labels, etc.

DESCRIPTION OF THE PRIOR ART

As is already known for the industrial preparation of so-called long length toilet paper rolls as well as rolls from which is possible to obtain labels of various shapes and possibly complete with various expressions and/or significant illustrations embossing and/or creasing devices are used. During the embossing operations, to join the numerous elementary layers present, for example in toilet paper, as well as in the execution of the creasing, or partial cutting which only involves a fraction of the thickness of the initial laminar material, technical problems are encountered due to the balancing and positioning of the tool, or of the tools specifically destined to perform the said embossing and/or creasing operations.

In fact, if balancing and positioning of the tool capable of exerting the desired pressure on the stratifications present in the multiple material for the production of multi-ply toilet paper rolls in the case of embossing, are not performed with great precision for the full linear development of the roll, or reel a repeated passage becomes necessary in the execution of the embossing operation, with the consequent interruption of processing.

In the case of creasing, technical problems are also encountered relative to the exactness with which incision of the starting material must be performed in each of the areas in which the starting material, if prearranged to produce labels must be sub-divided.

In fact, this sub-division requires great precision in establishing the depth, generally small fractions of a millimeter, critically reached by the incision achieved by the creasing tool.

These drawbacks of the known art are mainly due to the fact that with the known devices it is difficult to obtain and maintain a precise position of the creasing tools, which must perform the said partial cut depthwise; and in the case of embossing, it is difficult to achieve and maintain the exact orientation and the proper operation of all the embossing tools to be used on the stratification of the starting material that must be embossed.

These drawbacks are very noticable, particularly in the case of toilet paper and in the creasing of labels.

SUMMARY OF THE INVENTION

Now the applicant has found that the drawbacks and the limitations of the known devices described above may be overcome, in accordance with this invention, by using an improved device for embossing and/or creasing sheet, or roll material including: a fixed structure complete with a central, moving rod and two symmetric, side chambers in which two pistons slide with the relative stems, opposed by elastic means; means to supply a pressurised fluid to the upper part of each of the said chambers; an embossing and/or creasing tool-holder fixed to the free ends of the central rod and of the stems; a means to control the approach distance of the tool to the counter-roller and a means to micrometrically control the extent of the said approach.

The pistons, stressed by the fluid pressure, coherently and symmetrically move the embossing and/or creasing tool-holder towards a counter-roller on which the multi-layer bi-dimentional material to be treated advances.

The basic fixed structure is made connected to a shaped bracket that engages and is connected to a fixed beam. Numerous fixed structures with the relative embossing and/or creasing tool-holders may be prearranged on the said beam.

According to this invention, the embossing and/or creasing device includes to control means: one of which makes it possible to achieve an approximate position of the tool-holder in relation to the counter-roller on which the laminar bi-dimensional paper material to be embossed and/or creased advances; and the other makes it possible to perform a second calibration which may be defined "micro-metric", in particular to position the rotating tool, carried by the said tool-holder, at a distance that may be adjusted very precisely, with respect to the said counter-roller.

According to this invention, the said micrometric adjustment is carried out by the displacement, which is also micrometric, of a moving component with respect to a fixed component positioned underneath, with which the former forms a "wedge" or inclined plane type arrangement. To achieve the micrometric displacement, the moving component is associated with a calibrating screw integral with a knob, possibly graduated.

The means to supply the pressurised fluid, preferably compressed air, include a pressurised fluid source, a line, or ducting system forming a part of the fixed structure and a calibrated passage of the fluid, controlled by a screw already known in the art.

The tool-holder is associated with a replaceable, rotating tool, supported so as to allow replacement, for example to perform alternately one, or other of the said embossing and creasing operations.

BRIEF DESCRIPTION OF THE DRAWINGS

The structural and functional characteristics of the device, subject of this invention may be better understood from the following description where reference is made to the figures of the attached drawing that represent a preferred, exemplificative, illustrative, but nonlimitative embodiment and where.

DESCRIPTION OF THE PREFERRED EMBODIMENT

Figure 1:
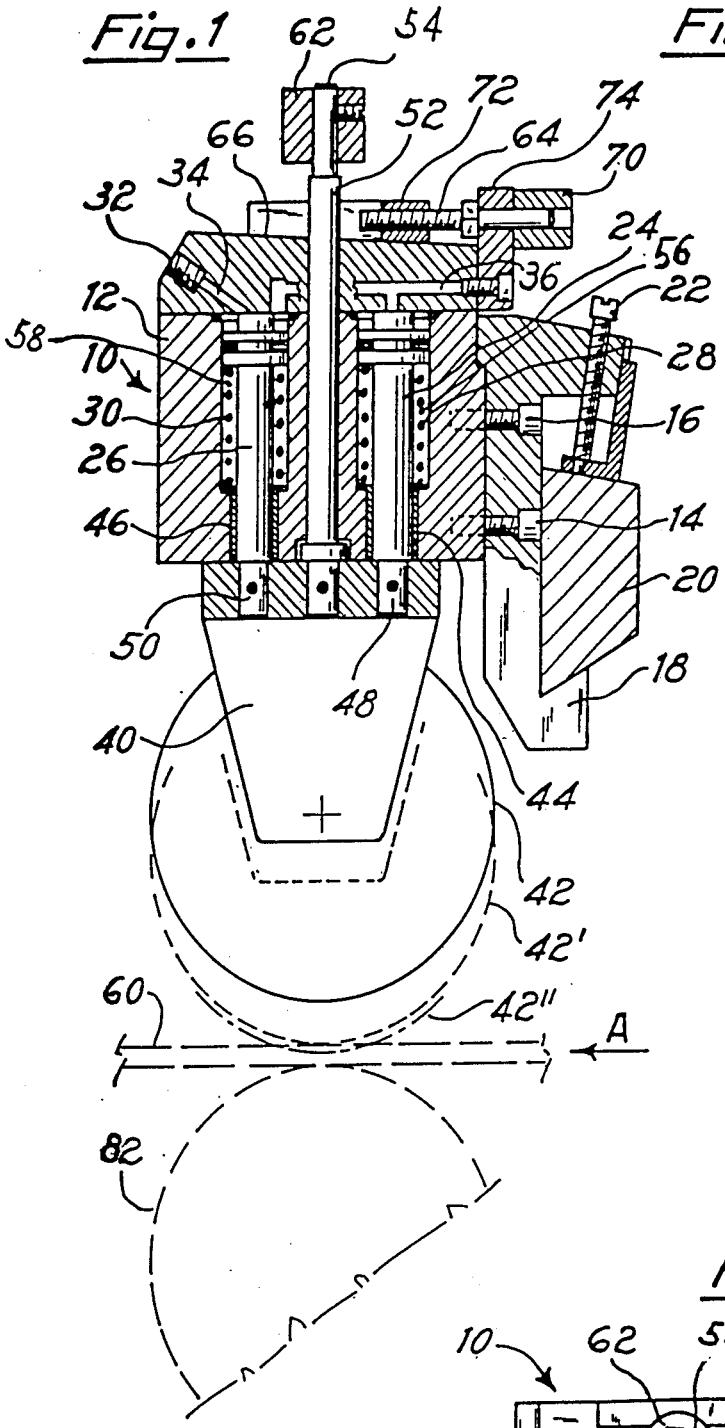
FIG. 1 represents a schematic, side-view, partially in cross-section, of the subject device.
Figure 2:
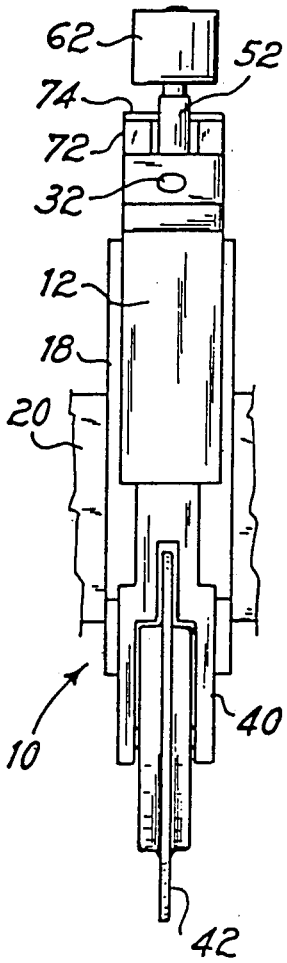
FIG. 2 represents a schematic front view, partially in cross-section, of the device of FIG. 1.
Figure 3:
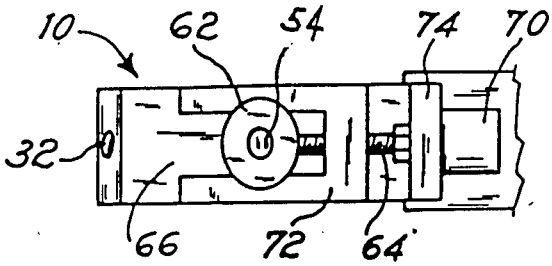
FIG. 3 represents a schematic plan view of the device of FIGS. 1 and 2.

With particular reference to the figures, the subject device, indicated with 10, includes a structure 12, which in general may be defined as fixed, since it is made integral with a bracket 18 by means of screws 14 and 16, the said bracket in turn may slide along a beam 20. The device 10 is fixed, for example, by means of a contrast screw 22, in the desired position on the said beam 20.

The structure 10 is complete with a central sliding rod 52 and with two side chambers 56 and 58 symmetrical with respect to the said rod 52. The small pistons 24 and 26 slide in the said chambers, the said small pistons are opposed by springs 28 and 30 and actuated by the pressure of a pressurised fluid, such as compressed air, supplied to the upper part of the said chambers through a calibrated passage 32. The compressed air, or other pressurised fluid, supplied from the passage 32, controlled by a screw, and through one, or more ducts 34 and 36 exerts a symmetrical axial thrust on the said small pistons 24 and 26 causing them to move downwards, overcoming the opposing force of the spring 28 and 30. The said small pistons 24 and 26 slide, guided inside bushings 44 and 46, positioned in the lower part of the chambers 56 and 58 and of the springs 28 and 30. The free end of the stems of the said small pistons 24 and 26 are fixed, for example, by pins 48 and 50, to a moving element 40 which fulfils the tool-holder function.

A tool 42 is mounted on the tool-holder 40 in a rotatable manner, the said tool may be either of the so-called "embossing" type, or of the so-called "creasing" type.

The guiding system detailed above, which includes guided sliding by the rod 52 and of the said small pistons 24 and 26, as well as the presence of the said bushings 44 and 46 allows perfectly straight and symmetric displacement of the mobile tool-holder element 40.

In this way a deviation-free approach of the tool 42 is assured starting from an initial position to then reach a first approximate service position of the tool in 42' in order to process the multi-layer material 60 that advances on the counter-roller 82.

The said counter-roller 82, preferably motor-driven, contrasts with the embossing and/or creasing tool 42, causing it to rotate, advancement of the material 60 being achieved, for example, on the plane and in the direction indicated by A. The end 54 of the central rod 52 is threaded and a head 62 is screwed onto it.

The position of the head 62, with respect to the fixed structure 12, makes it possible to obtain an initial approximate service adjustment of the tool 42.

When this adjustment does not correspond to the processing requirements, for example, those of creasing, a more accurate calibration means is adopted. This calibration means includes a moving component 72 that slides on an inclined plane 66 consisting of the upper face of the fixed structure 12 of the device 10.

This calibration, which because of the very high accuracy achievable is properly defined "micrometric", is achieved for example by using a knob 70, possibly graduated, integral with a screw 64 that passes through a fixed plate 74 and that engages in the said moving component 72. When, due to processing requirements, the tool 42 of the approximate position 42' must be moved to a position 42'', the micrometric adjustment may be achieved by using the knob 70 and then displacing the moving component 72 on which the head 62 rests. Each small piston 24 and 26 is complete with sealing means, such as O-rings and whatever else may be necessary and/or appropriate to assure the complete seal and the proper operation of the device.

It is clear that the device of this invention allows a perfectly straight and symmetrical descent of the tool 42 towards the multiple material 60 to be processed by embossing and/or creasing, thereby rationally overcoming the technical problems detailed above.

Furthermore, the device of this invention allows the desired micrometric adjustment and positioning of the tool 42 to be achieved in relation to the thickness of the material 60 to be treated, in particular in the creasing operations where, as is known, only a fraction of the material to be treated must be selectively cut.

What I claim is:

1. Device for embossing and/or creasing paper in sheet, or rolls, including a fixed structure, at least a tool holder, movable selectively and a system to adjust the degree of approach of the tool to the counter-roller, where the fixed structure is complete with a mobile, central rod, two symmetrical, side chambers where two pistons slide, with the relative stems, opposed by elastic means and a calibrated passage to supply a pressurised fluid in the upper part of each chamber; the tool-holder is fixed to the free-ends of the central rod and of the stems; and the system to adjust the degree of approach, includes a means to obtain an approximate approach and a means to achieve micrometric adjustment of the extent of the said approach.

2. Device, according to claim 1, where the means to achieve an approximate approach of the tool-holder with respect to the counter-roller, includes a head fixed in an adjustable manner to the end of the central rod.

3. Device, according to claim 2, where the means to achieve micrometric adjustment of the tool-holder with respect to the counter-roller, includes a moving component that slides on an inclined plane, so as to form a wedge shaped system; the movement of the said component being obtained by a knob fixed to a screw that passes though a fixed plate and which engages in the said moving component.

4. Device, according to claim 2, where the inclined plane consists of the upper face of the fixed structure.

5. Device, according to claim 1, wherein the calibrated passage of the pressurised fluid is controlled by a screw.

6. Device, according to claim 1, wherein the fixed structure is solidly connected to a bracket movable by sliding along a fixed beam and which may be fixed to it using anchoring means.

7. Device, according to claim 6, wherein numerous tool-holders are pre-arranged on the beam, the said tool-holders carrying the embossing and/or creasing means.

* * * * *